US006276601B1

(12) United States Patent
Ross et al.

(10) Patent No.: US 6,276,601 B1
(45) Date of Patent: Aug. 21, 2001

(54) COMBINED LETTER AND ENVELOPE FOR DUAL ORIENTATION PRINTING

(76) Inventors: Robert K. Ross, 105 Fireside Cir., Baltimore, MD (US) 21212-2417; John A. Yatsko, 11785 Little Cove Point Rd., Lusby, MD (US) 20657

( * ) Notice: Subject to any disclaimer, the term of this patent is extended or adjusted under 35 U.S.C. 154(b) by 0 days.

(21) Appl. No.: 09/157,135

(22) Filed: Sep. 18, 1998

(51) Int. Cl.[7] ..... B65D 27/06; B65D 27/34
(52) U.S. Cl. ..... 229/305; 229/70
(58) Field of Search ..... 229/70, 301, 92.1, 229/92.3, 305, 306

(56) References Cited

U.S. PATENT DOCUMENTS

| | | | | |
|---|---|---|---|---|
| 3,507,519 | * | 4/1970 | McNabb | 229/305 |
| 3,726,471 | * | 4/1973 | Kalb | 229/92.8 |
| 3,952,942 | * | 4/1976 | O'Leary et al. | 229/305 |
| 4,190,162 | * | 2/1980 | Buescher | 229/305 |
| 4,313,557 | * | 2/1982 | Foffel | 229/301 |
| 4,334,618 | * | 6/1982 | Buescher | 229/305 |
| 4,632,427 | * | 12/1986 | Angus | 229/304 |
| 4,715,531 | * | 12/1987 | Stewart et al. | 229/306 |
| 4,756,468 | * | 7/1988 | Jenkins | 229/304 |
| 4,815,654 | * | 3/1989 | Buescher | 229/305 |
| 5,104,036 | | 4/1992 | Rutkowski et al. . | |
| 5,169,061 | * | 12/1992 | Buescher | 229/305 |
| 5,285,958 | * | 2/1994 | Buescher | 229/306 |
| 5,288,014 | * | 2/1994 | Meyers et al. | 229/304 |
| 5,377,904 | * | 1/1995 | Michlin et al. | 229/70 |
| 5,464,255 | * | 11/1995 | Schildmeyer | 229/304 |
| 6,027,014 | * | 2/2000 | Cochran | 229/70 |

* cited by examiner

*Primary Examiner*—Stephen P. Garbe
(74) *Attorney, Agent, or Firm*—H. Jay Spiegel

(57) ABSTRACT

A first embodiment of combined letter and envelope includes a single piece of paper divided into halves by a crease. A front half has two regions divided by a first perforation extending through both the front half and the back half of the paper. The rear half is also divided into upper and lower regions at the same perforation. The rear half has a second perforation extending only through the rear half and slightly below the first perforation so that a narrow horizontal strip of paper may be removed to reveal a narrow flap on the front half having a rear surface covered by an adhesive. The envelope is created by removing the lower regions of the front and rear halves from the upper regions at the first perforation, removing the strip of paper defined by the second perforation, wetting the adhesive that is exposed by removal of the narrow horizontal strip of paper, and folding the flap with the glue over a rear surface of the lower region of the rear half of the piece of paper to seal the envelope. In a second embodiment of the present invention, the single piece of paper used to form the combined letter and envelope is longer than is the case in the first embodiment to provide an additional region to provide additional information from the sender. In a third embodiment, a middle section is used to provide an additional envelope along with a stub. The method of manufacturing is also disclosed.

15 Claims, 7 Drawing Sheets

COMBINED LETTER AND ENVELOPE FOR DUAL ORIENTATION PRINTING

BACKGROUND OF THE INVENTION

The present invention relates to a combined letter and envelope for dual orientation printing. Devices including a mailer having printed information thereon such as, for example, an invoice or bill are well known. The main purpose for such devices is to provide convenience to a customer, giving them a bill or invoice while also providing a convenient envelope in which payment and a reply/receipt may be inserted for mailing back to the vendor.

A need has developed for a combined letter and envelope that is simple in construction, easy to use by the consumer, easy to print on using standard home office printing equipment, and easy and cheap to manufacture. It is with these needs in mind that the present invention was developed.

Applicants are aware of U.S. Pat. No. 5,104,036 to Rutkowski et al. that discloses a mailer with reply envelope. In the Rutkowski et al. device, two separate sheets of paper are adhered to one another at prescribed locations to provide a message section along with a reply envelope. The present invention differs from the teachings of Rutkowski et al. as contemplating constructing a combined letter and envelope of a single sheet of paper folded in half and including fewer perforations and adhesive sections than is the case with Rutkowski et al. The present invention also differs from Rutkowski et al. as contemplating a unique manufacturing process therefor not contemplated by Rutkowski et al.

SUMMARY OF THE INVENTION

The present invention relates to a combined letter and envelope for dual orientation printing. The present invention includes the following interrelated objects, aspects and features:

(1) The present invention is disclosed in terms of embodiments of a combined letter and envelope as well as the method of fabrication of same.

(2) A first embodiment of combined letter and envelope in accordance with the teachings of the present invention includes a single piece of paper divided into halves by a crease. A front half has an upper region and a lower region divided by a first perforation extending through both the front half and the back half of the piece of paper. The rear half of the piece of paper is also divided into upper and lower regions at the same perforation. The rear half has a second perforation extending only through the rear half and slightly below the first perforation so that a narrow horizontal strip of paper comprising a portion of the rear half may be removed to reveal a narrow strip or flap on the front half of the piece of paper having a rear surface covered by a wettable adhesive.

(3) The crease dividing the single piece of paper into front and rear halves is located in a location dividing the lower portions of the front and rear halves from one another and, thereby, forming the bottom extent of the envelope. Thus, it should be understood that the return envelope may be created by removing the lower regions of the front and rear halves from the respective upper regions thereof at the first-mentioned perforation, removing the strip of paper defined by the second perforation, wetting the wettable adhesive that is exposed by removal of the narrow horizontal strip of paper, and folding the flap with the wettable glue thereon over a rear surface of the lower region of the rear half of the piece of paper to seal the envelope. The sides of the envelope are suitably sealed together by an adhesive during the manufacturing process.

(4) The upper regions of the front and rear halves of the piece of paper are adhered together through adhesive deposited thereon during the process of manufacture. Once the first perforation is torn to separate the envelope from the letter, an opening is formed between the upper regions of the front and rear halves and the upper regions may be separated from one another in a manner well known to those skilled in the art to reveal the rear surface of the front half upper region and the front surface of the rear half upper region. Invoice or other information may suitably be printed on one or both of these surfaces and separate areas may be defined, as desired, for example, to provide a receipt or reply form.

(5) In a second embodiment of the present invention, the single piece of paper used to form the combined letter and envelope is longer than is the case in the first embodiment. For example, in the first embodiment, the piece of paper employed to make the combined letter and envelope is approximately 8½ inches wide by 22 inches long so that, when folded, the combined letter and envelope is letter size. In the second embodiment of the present invention, that portion of the front and rear halves from about one-third of the way down from a top edge thereof is similar to the first embodiment. The additional length of the front and rear halves of the piece of paper employed to form the second embodiment of the present invention provides an additional region to provide additional information from the sender. If desired, the length of the second embodiment may be divided into approximate thirds, with creases between each region thereof so that first and second regions of the front and rear halves of the inventive device may be folded to provide a two or four page area to provide a letter, invoice, or combination thereof. The approximately lower one-third of the front and rear halves is used to form an envelope in the same manner as is the case in the first embodiment.

(6) In a third embodiment of the present invention, approximately the lower one-third of the front and rear halves of the piece of paper is similar to those of the first and second embodiments and may be used to provide an envelope. A middle section thereof may be used to provide an additional envelope along with a payment stub or other printed matter. An upper region may be used to provide a variable letter, invoice, or a combination thereof. In the same manner as is the case in the first and second embodiments, the crease between the front and rear halves of the piece of paper is at the bottom of the device and forms the bottom extent of the envelope located at the lower region thereof.

(7) As explained hereinabove, the present invention also contemplates the method of manufacturing the subject combined letter and envelope embodiments. As explained above, the inventive combined letter and envelope, in its various embodiments, is made of a single piece of paper folded at a crease to provide two parallel sheets of paper with the crease forming the bottom of an envelope incorporated therewith. Through this construction, advantageously, the manufacturing process may be implemented by providing an elongated roll of a paper web that is unrolled and conveyed along a production line during the course of manufacture.

(8) During the course of manufacture, as will be explained in greater detail hereinafter, areas of glue of different kinds are applied to prescribed regions on the paper web for particular purposes. For example, wet glue is applied to regions of the paper that will be adhered together, for example, facing upper regions of the front and rear halves after the paper is appropriately folded. Wettable glue is applied at other areas, particularly where a flap will be formed for the envelope located at the lower portions of the front and rear halves of the piece of paper forming the combined letter and envelope.

(9) At one location along the manufacturing line, a perforator is provided to provide perforations on the front and rear halves of the creased piece of paper to permit separation of upper and lower portions of the front and rear halves thereof. At another location along the manufacturing line, a perforator is provided which solely perforates at a location on the rear half of the piece of paper to allow formation of the flap of the incorporated envelope. A sheet stacker is provided to stack the finished combined letter and envelope devices.

Accordingly, it is a first object of the present invention to provide a combined letter and envelope.

It is a further object of the present invention to provide such a device wherein a single piece of paper is creased at an appropriate location to provide a bottom extent of an envelope incorporated therewith.

It is a yet further object of the present invention to provide such a device with a perforation extending through front and rear halves thereof to allow separation of upper and lower portions thereof.

It is a still further object of the present invention to provide such a device, in one embodiment thereof, wherein an envelope is provided along with a region used for a letter and/or invoice.

It is a yet further object of the present invention to provide such a device wherein two envelopes are provided.

It is a still further object of the present invention to provide such a device wherein a single envelope is provided along with two separate panels allowing creation of a two or four page letter or invoice.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
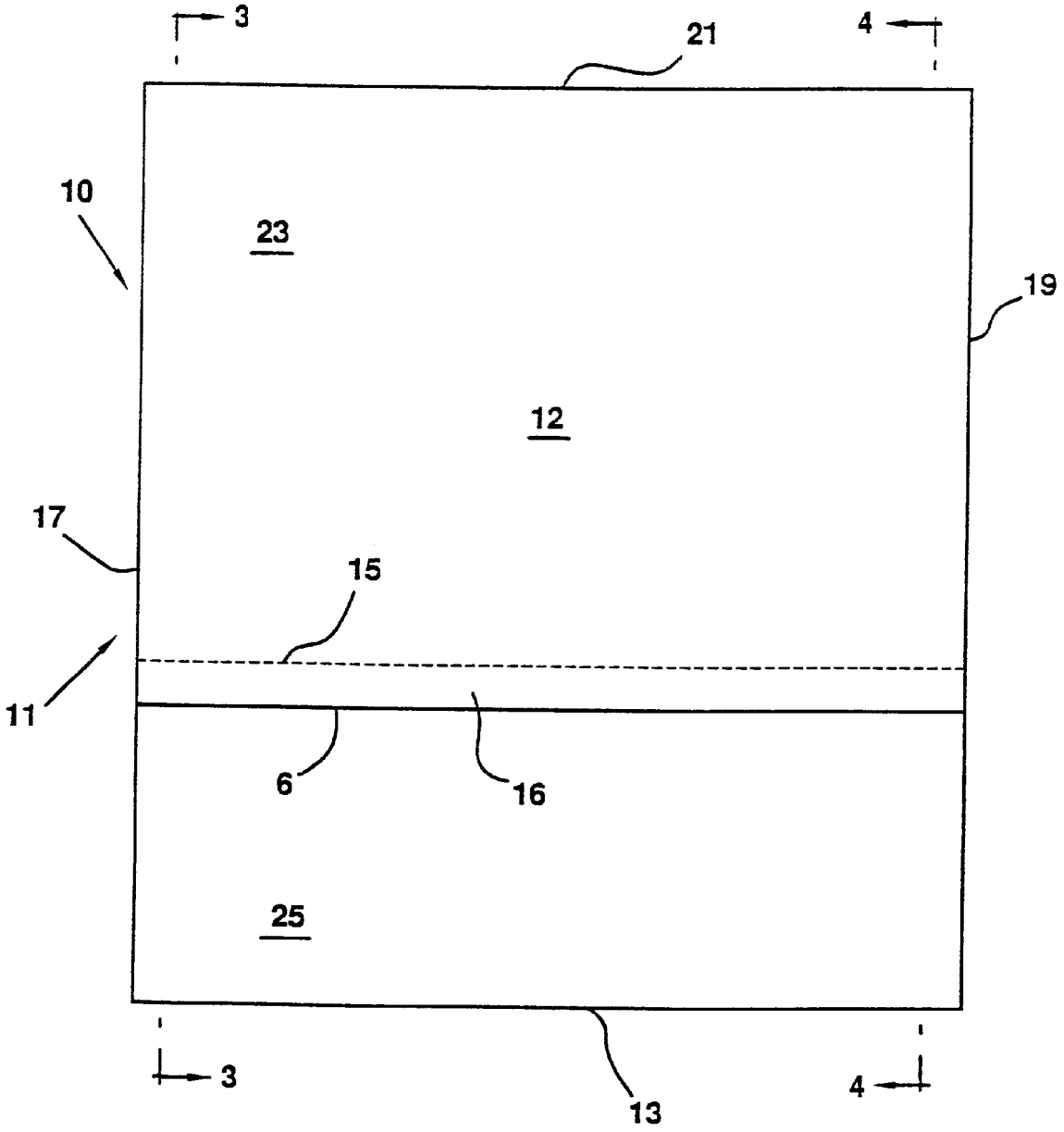
FIG. 1 shows a top view of a first embodiment of combined letter and envelope in accordance with the teachings of the present invention.

With reference, first, to FIGS. 1–4, details of a first embodiment of the present invention will be described in detail. With reference to FIG. 1, a first embodiment of combined letter and envelope is generally designated by the reference numeral 10 and is seen to include a front half 11 having a front surface 12, a crease 13, a perforation 15, side edges 17 and 19, a top edge 21, an upper region 23, and a lower region 25, with these regions being separated by the perforation 15. Between the line 6 and the perforation 15, the front half 11 includes a strip 16 that has adhesive 48 on its rear surface so that the strip 16 comprises a flap that may be folded over to seal the envelope.

Figure 2:
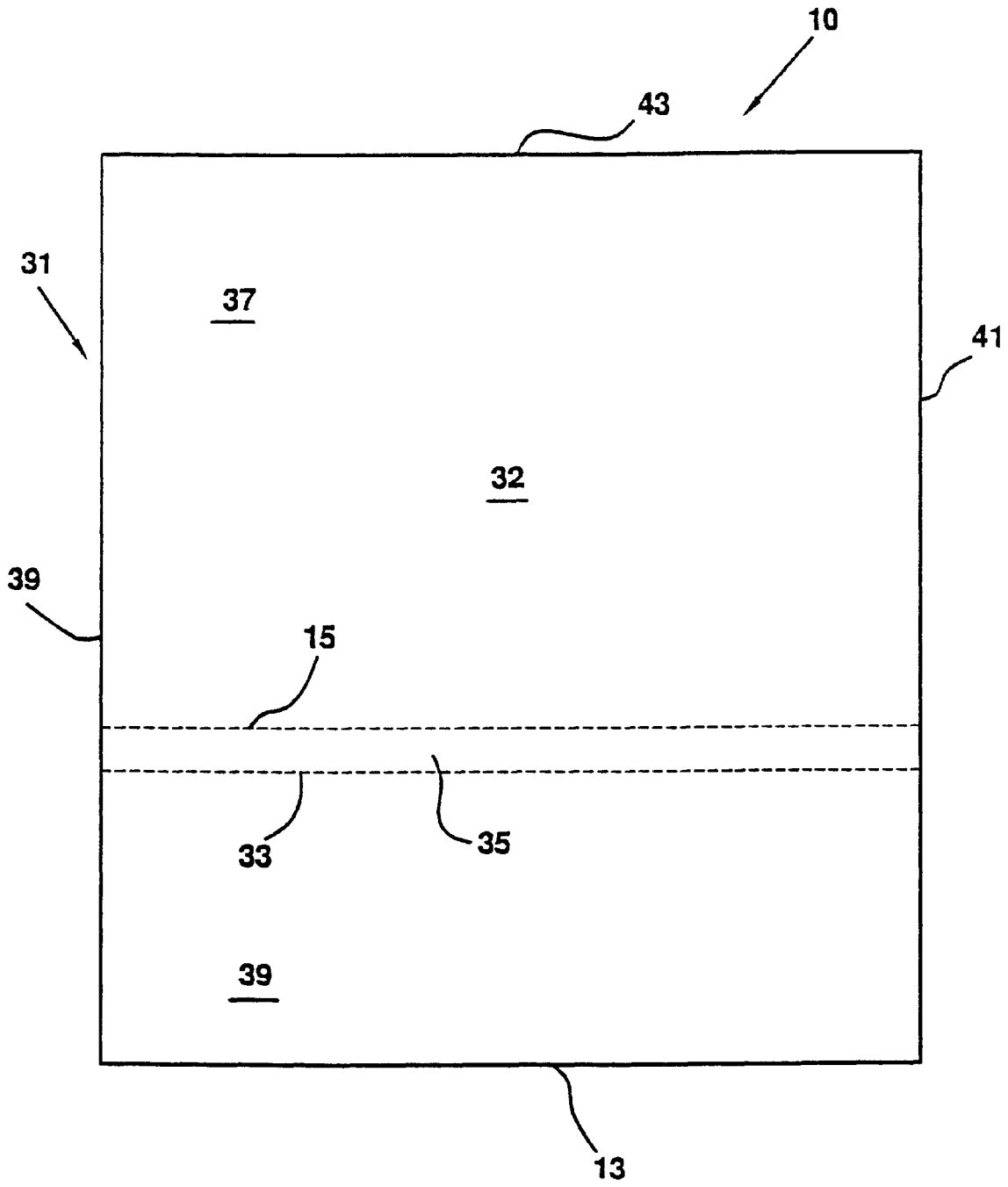
FIG. 2 shows a rear view thereof.

With reference to FIG. 2, the combined letter and envelope 10 also includes a rear half 31 having a rear surface 32, with the crease 13 being visible as well as the perforation 15. A further perforation 33 extends through the surface 32 with the perforations 15 and 33 defining a narrow horizontal strip 35 for a purpose to be described in greater detail hereinafter.

The rear half 31 includes an upper region 37 as well as a lower region 39 with the regions being defined by the perforation 15. The rear half 31 also includes side edges 39 and 41 and a top edge 43.

Figure 3:
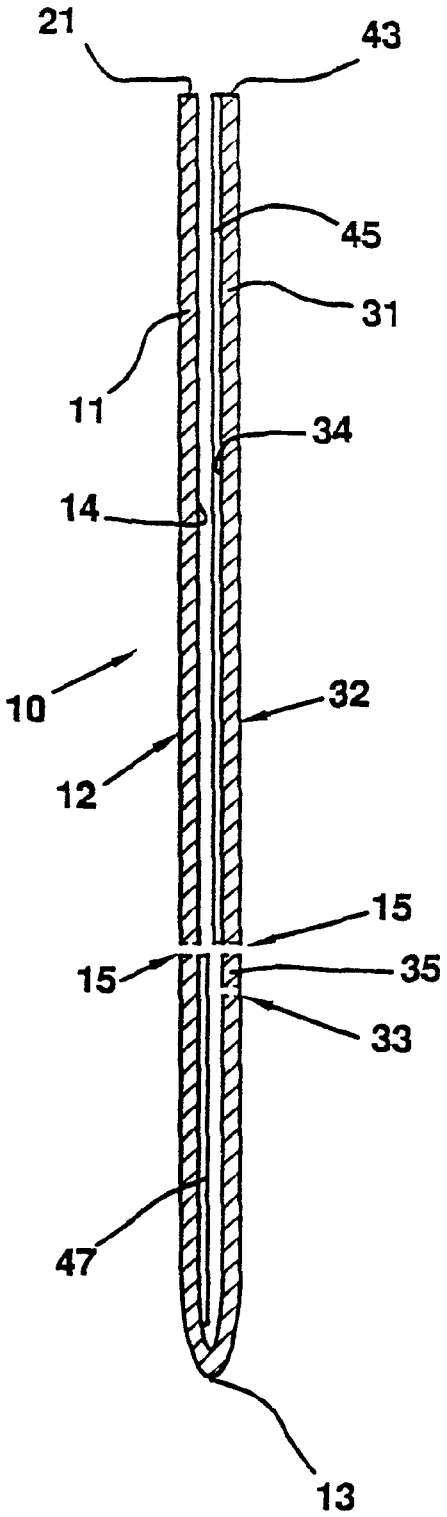
FIG. 3 shows a cross-sectional view along the line 3—3 of FIG. 1.
Figure 4:
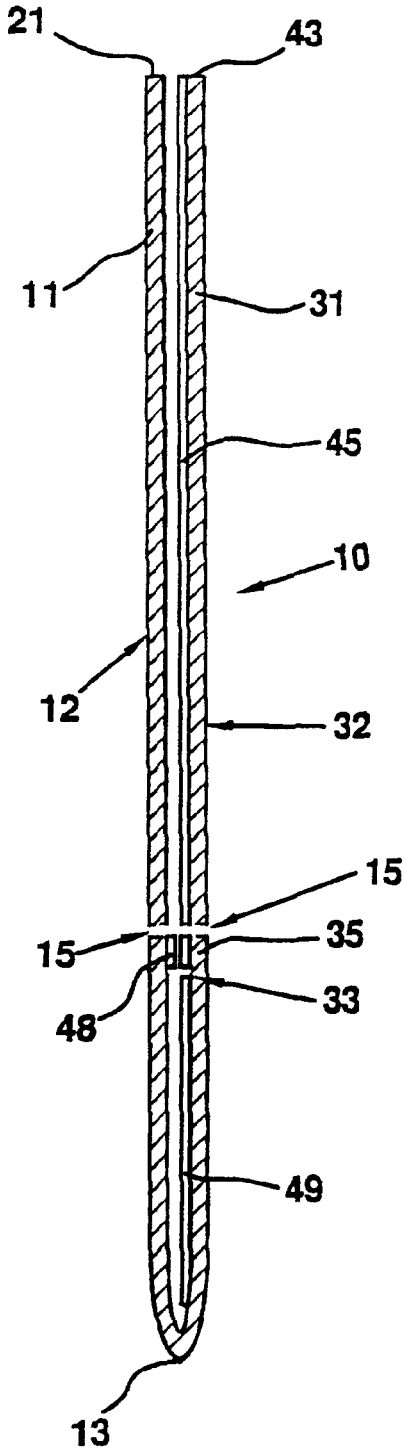
FIG. 4 shows a cross-sectional view along the line 4—4 of FIG. 1.

With reference to FIGS. 3 and 4, the relationship between the front and rear halves is better understood. As seen in FIGS. 3 and 4, a layer of adhesive 45 is disposed on the front surface 34 of the rear half 31 and adheres to the rear surface 14 of the front half 11 to adhere the upper regions 37 and 23 together.

Figure 6:
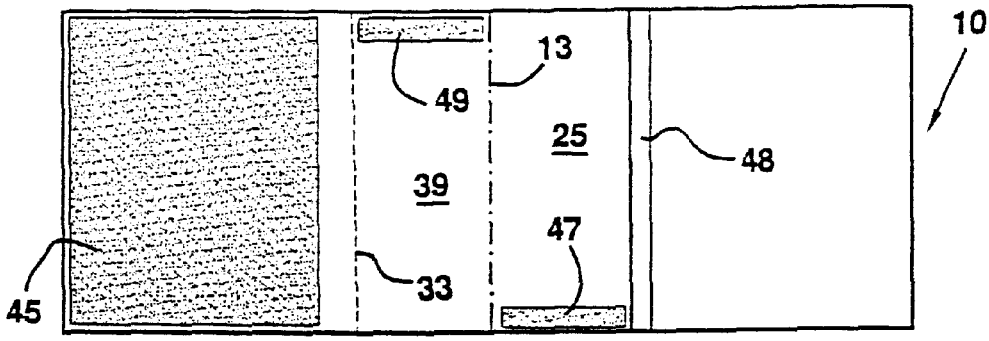

With further reference to FIGS. 3 and 4 and with additional reference to FIG. 6, it is seen that glue strips 47 and 49 are provided which adhere the side edges 17, 41 and 19, 39, respectively, together in the area of the lower regions 25 and 39 to enclose the area defining the lower regions 25 and 39 as an envelope.

Figure 5:
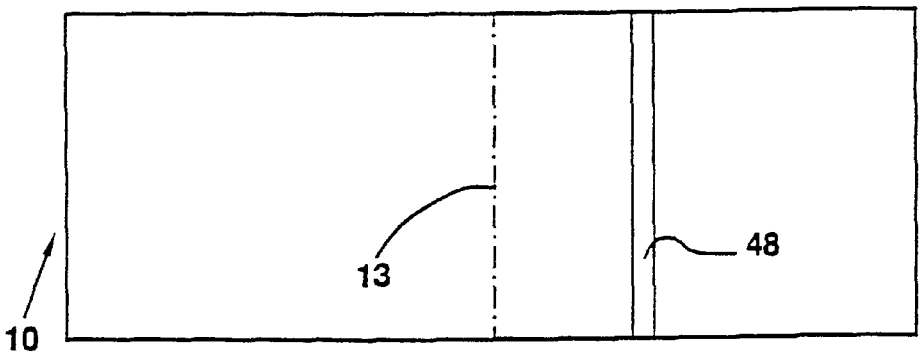
FIGS. 5–8 show four stages of manufacture of the device illustrated in FIGS. 1–4.

With particular reference to FIGS. 5–8, the combined letter and envelope 10 is seen in its various stages of manufacture. FIG. 5 shows the crease 13 as well as a strip 48 (also seen in FIG. 4) of moistenable glue that will provide adherence of a flap portion of the envelope formed by the lower regions 25, 39 of the device 10. FIG. 6 shows a region 45 of wet glue (also seen in FIGS. 3 and 4) that adheres the upper regions 23, 37 together when the device 10 is folded at the crease 13. FIG. 6 also shows the regions 47 and 49 of glue (also seen in FIGS. 3 and 4, respectively), that adhere the side edges of the regions 25, 39 to form, along with the crease 13, the enclosure of the envelope. FIG. 6 also shows the perforation 33.

Figure 7:
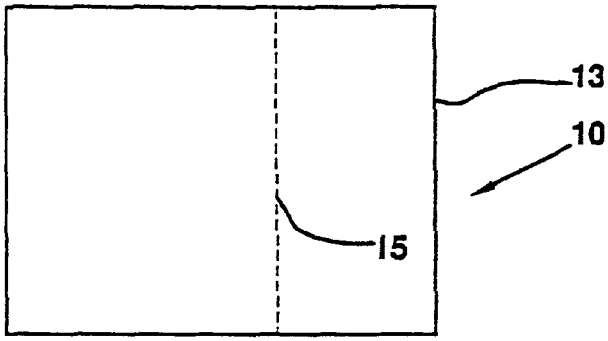
Figure 8:
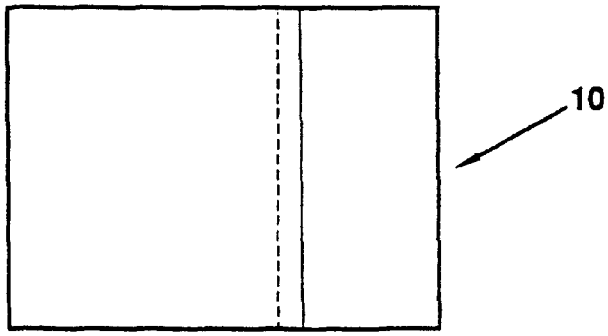

FIG. 7 shows the device 10 after being folded upon itself at the crease 13, whereupon the perforation 15 is provided. FIG. 8 shows the completed device 10 with printing thereon as appropriate.

Figure 9:
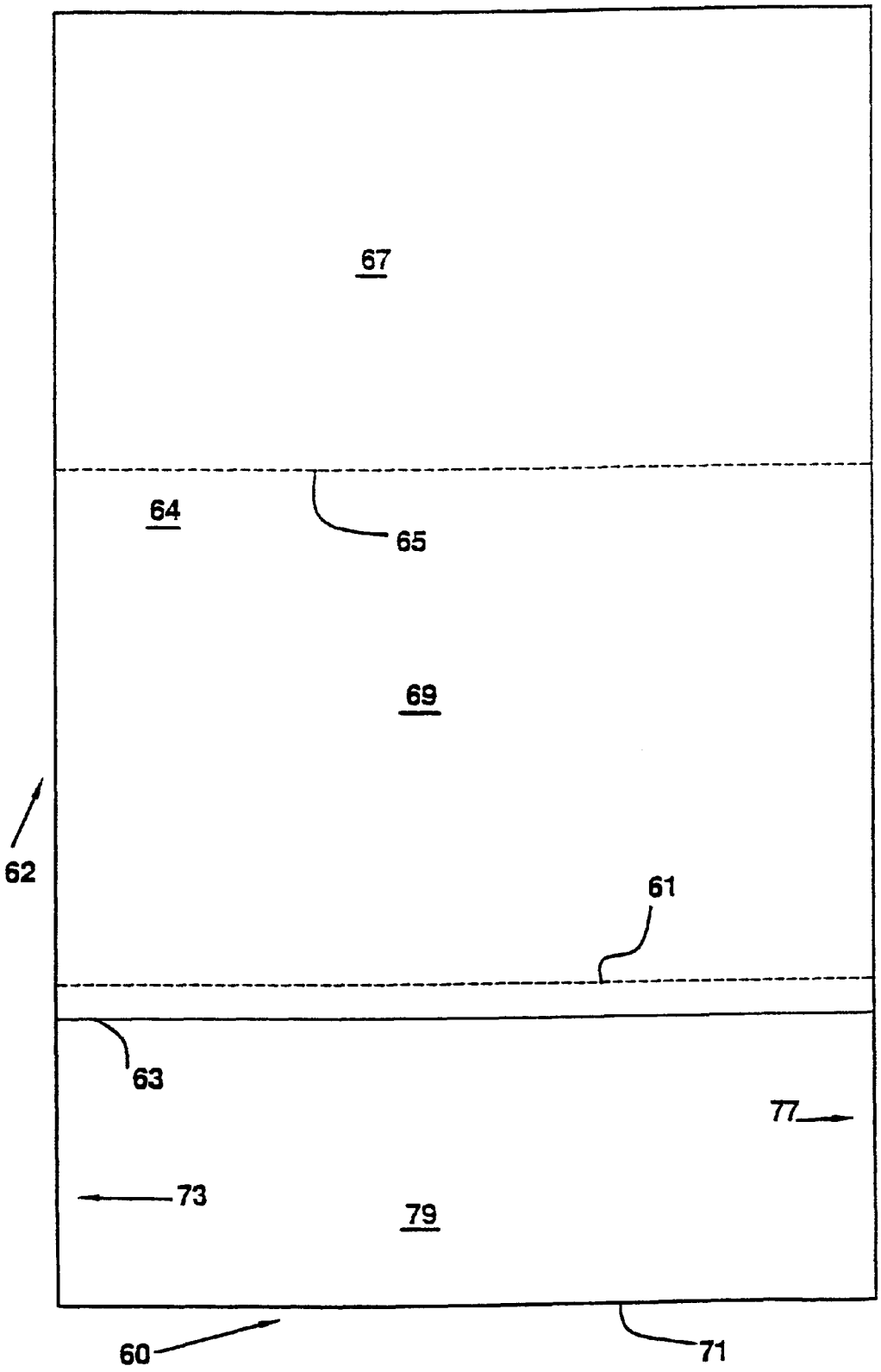
FIG. 9 shows a front view of a second embodiment of combined letter and envelope.

With reference, now, to FIG. 9, a further embodiment of the present invention will now be described. The second embodiment of the present invention is generally designated by the reference numeral 60 and is similar to the device 10 illustrated in FIGS. 1–8 but is slightly elongated to provide a larger region for provision of a letter and/or invoice.

As seen in FIG. 9, the device 60 includes a perforation 61 extending through the front sheet 62 as well as the rear sheet (not shown). At the location of the line 63, a perforation is provided in the rear sheet (not shown) but not in the front sheet in the same manner as is the case for the perforation 33, best seen in FIG. 2. An additional perforation 65 is provided that bisects an upper region 64 of the device 60 into a first region 67 and a second region 69. The perforation 65 may extend through the front and rear (not shown) sheets of the device 60. A fold or crease 71 is provided at the lower end of the device 60 corresponding to the crease 13, best seen with reference to FIGS. 1–8. The front and rear halves of the sheet used to form the device 60 are adhered together above the perforation 61 in the same manner as is the case through use of the adhesive 45, best seen in FIG. 6, for the device 10. Adhesive portions (not shown) corresponding to the adhesive portions 47 and 49, best seen with reference to FIGS. 3, 4 and 6, are provided in the regions 73 and 77, respectively, which combine with the crease 71 to form an enclosure for the envelope region 79.

Figure 10:
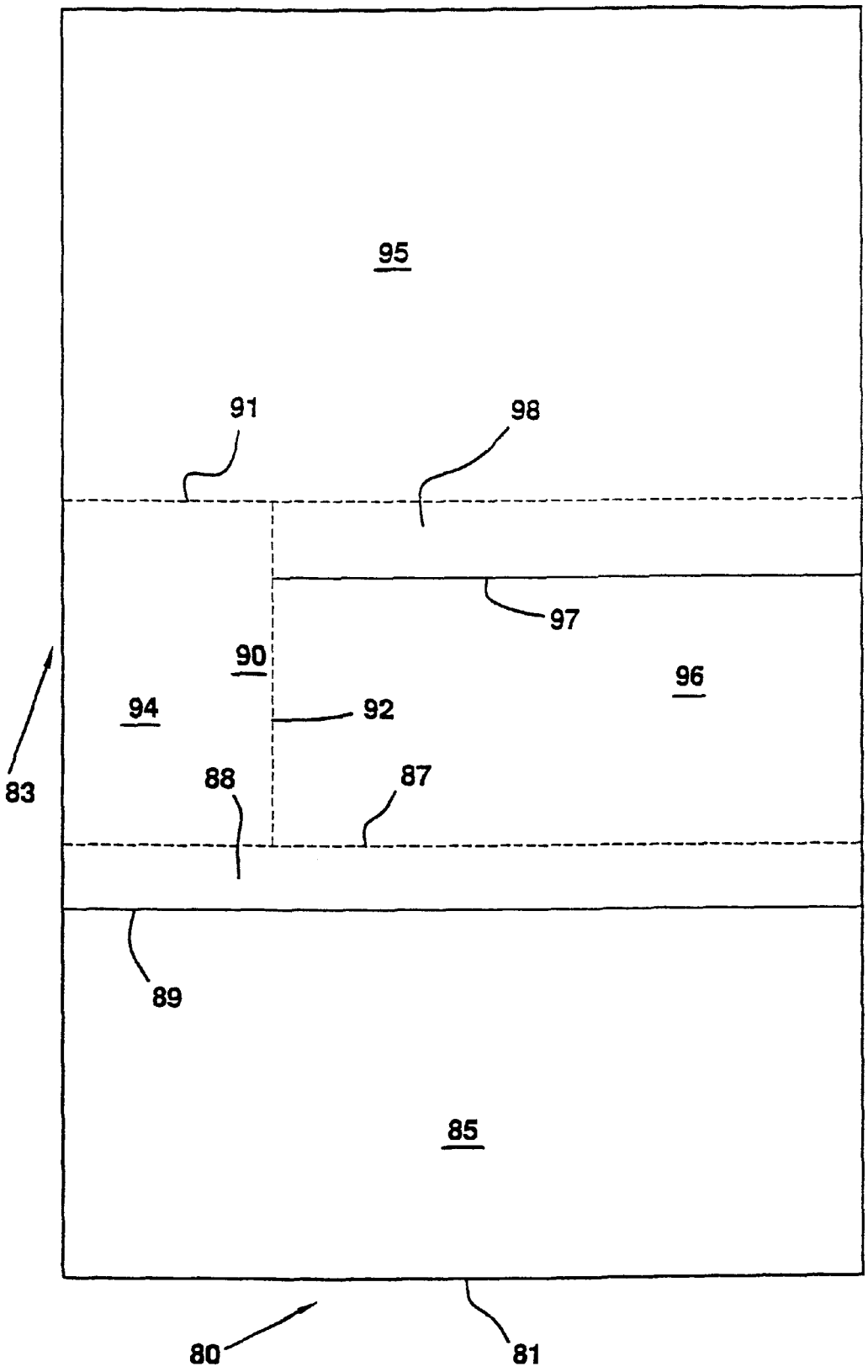
FIG. 10 shows a front view of a third embodiment of combined letter and envelope.

With reference to FIG. 10, a third embodiment of combined letter and envelope is generally designated by the reference numeral 80 and is seen to include a crease 81 that defines a front half 83 and a rear half (not shown). An envelope region 85 is provided that is defined by a perforation 87 through the front and rear halves, a perforation aligned with the line 89 but only extending through the rear half in correspondence to the perforation 33, best seen in FIG. 2.

The perforation 87 allows separation of the envelope 85 from the rest of the device 80 and a further perforation 91 through the front and rear halves allows separation of a middle section 90 from the envelope region 85 and an upper region 95. When the middle region 90 has been separated, a further perforation 92 through the front and rear halves allows separation of a variable payment stub 94 from the rest of the middle region 90 designated by the reference numeral 96 and comprising a variable return or business reply envelope. The rear half (not shown) includes a perforation aligned with the line 97 that allows peeling a strip between the rear perforation and the perforation 91 and aligned with the region 98 in the front half 83 to provide for use of the region 98 as a fold-over strip that is covered on its rear surface with adhesive in the same manner as the adhesive 48, best seen in FIG. 4. Between the perforation 87 and the line 89, a flap 88 is defined that has adhesive on its rear surface corresponding to the adhesive 48, best seen in FIG. 4, so that the strip 88 comprises a flap that may be folded over to seal the envelope 85.

Based upon the description of the device 10 illustrated in FIGS. 1–8, the rest of the features of the device 80 should be self-evident. One may remove the envelope 85 from the rest of the structure of the device 80 at the perforation 87 and may remove the upper region 95 from the rest of the structure at the perforation 91. As explained above, the perforations 87 and 91 both extend. through the front and rear halves of the device 80. The region 95 has inner surfaces on which appropriate printing may be provided.

Reference is now made to FIGS. 11–16 so that a better understanding of the preferred process of manufacture may be had.

Figure 11:
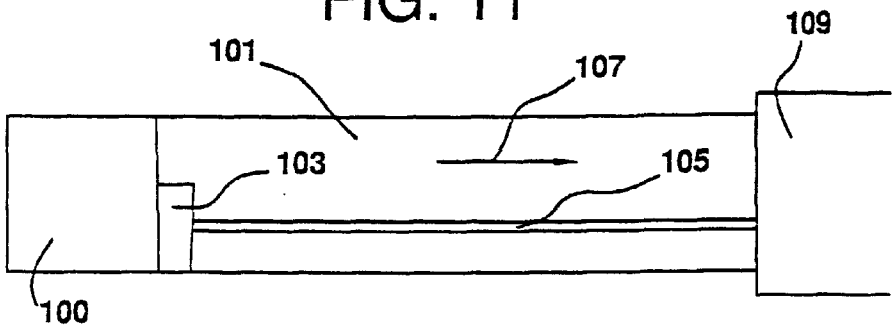
FIGS. 11 and 12 show top and side views, respectively, of the travel of a paper web through a first portion of the manufacturing process of the combined letter and envelope.
Figure 12:
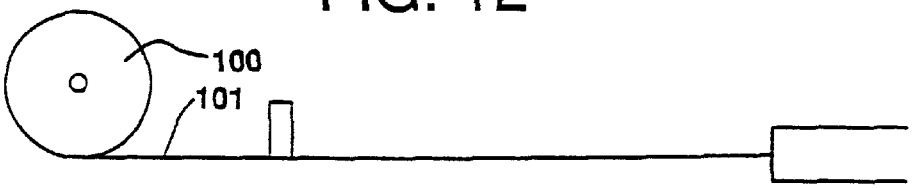
Figure 13:
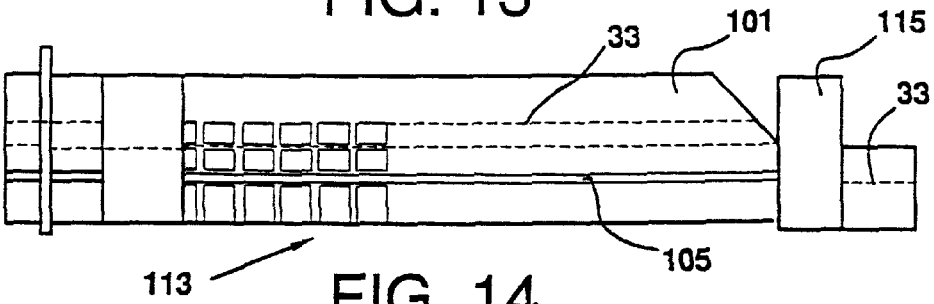
FIGS. 13 and 14 show top and side views, respectively, of a second portion of the manufacturing process.
Figure 14:
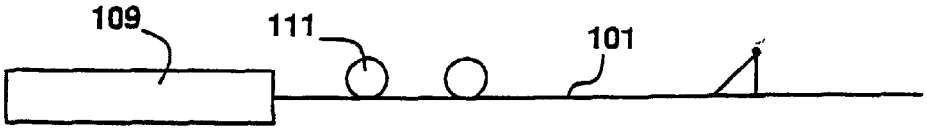

With reference to FIGS. 11 and 12, as explained hereinabove, one great advantage of the present invention over the prior art lies in the fact that the inventive combined letter and envelope is created out of a single sheet of paper folded upon itself to provide a double thickness. Due to this aspect, an assembly line may be employed that conveys a web 101 of paper from a roll 100 thereof through the various stations necessary to create the inventive device in its embodiments.

In the view of FIG. 11, the vertical direction corresponds to the same direction in the view, for example, of FIG. 1. FIGS. 11 and 12 show an applicator 103 that applies a strip 105 of glue corresponding, for example, to the strip 48, best seen in FIGS. 4, 5 and 6. As the web travels in the direction of the arrow 107, it enters an oven 109 that dries the glue. Thereafter, with reference to FIGS. 13 and 14, the web 101 travels under a perforated wheel 111 that creates the rear perforation 33 (FIGS. 2, 3 and 4) and includes further glue applicators 113 which apply the glue regions 45, 47 and 49, best seen in FIG. 6. Thereafter, the web 101 travels through a folding mechanism 115 that folds the device 10 to the configuration best seen with reference to FIGS. 3, 4 and 7, forming the crease 13.

Figure 15:
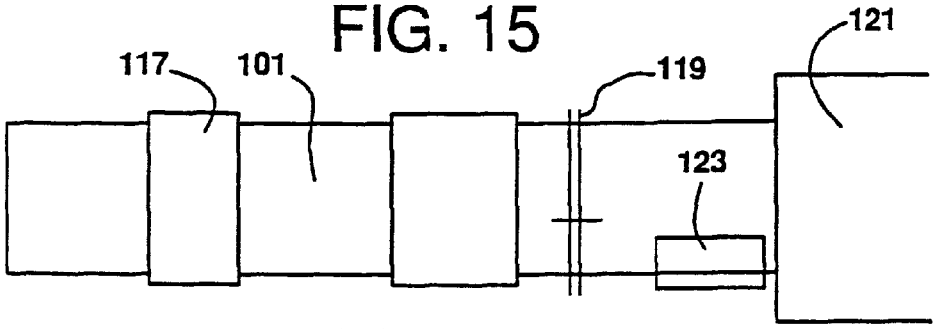
FIGS. 15 and 16 show top and side views, respectively, of a third portion of the manufacturing process thereof.
Figure 16:
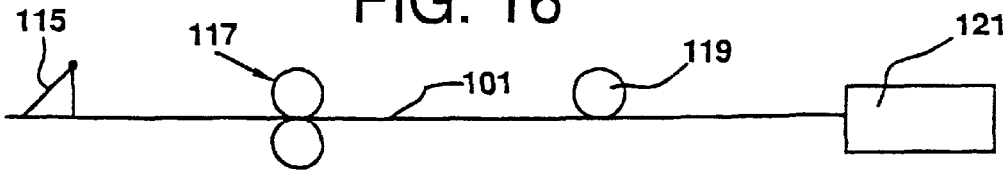

With reference to FIGS. 15 and 16, "downstream" of the folder 115, the preliminarily folded device 10 is passed through smoothing cylinders 117 that press the front and rear halves together adhering the glue regions 45, 47 and 49. Thereafter, the web 101 passes through a further perforator 119 that forms the perforation 15 through the front and rear halves, whereupon the finished product is stacked in a sheeter/stacker 121. As seen in FIG. 15, a trimmer 123 may be provided just upstream of the sheeter/stacker 121 to trim the edge of the web.

As should now be understood, particular characteristics of the embodiments of the present invention described above render the process of manufacture quite simple and economical. The finished product in its embodiments effectively allows a vendor to bill a client or send a long letter requesting, for example, a charitable contribution in a combined single piece mailer that provides the recipient with a convenient envelope to be used to send a contribution or, for example, mail a letter to a third party. For example, the inventive device may be employed concerning political issues wherein the entity sending the device wishes to have the recipient send a letter to a Congressman or Senator as well as sending a contribution back to the sender. For example, the embodiment designated by the reference numeral 80 and illustrated in FIG. 10 is ideal for this purpose in that, for example, the upper region 95 may be used to include a written solicitation inside, one envelope may be employed to send a letter to a Congressman or Senator, and the other envelope may be used to send a contribution to the sender from the recipient.

The simple construction and dimensions of the embodiments of the present invention, including the use of a creased and folded web of paper, facilitates printing of a desired message on an ordinary home office-type laser or ink-jet printer in either one of two perpendicular orientations, also known as dual orientation printing. Applicants acknowledge the existence of and anticipate greater use of computer software technology that allows for dual orientation printing. Dual orientation printing prints "Portrait" and "Landscape" orientations at the same time. "Portrait" prints correct reading text and graphics on a standard letter size sheet (8.5×11) with the top and bottom edges 8.5 and left and right edges 11. "Landscape" prints correct reading text and graphics on a standard letter size sheet (8.5×11) with the top and bottom edges 11 and the left and right edges 8.5.

As such, an invention has been disclosed in terms of preferred embodiments thereof as well as a preferred process for manufacture that fulfill each and every one of the objects of the invention as set forth hereinabove, and provide a new and useful combined letter and envelope for dual orientation printing as well as the preferred process of manufacture, of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A combined letter and envelope comprising:

a) an elongated generally rectangular web folded in half at a crease to define a front half and a rear half, said crease defining lower extents of said halves;

b) a first perforation extending horizontally through said front and rear halves;

c) a second perforation slightly below and parallel to said first perforation and extending solely through said rear half;

d) an upper region above said first perforation comprising a letter or invoice;

e) a lower region below said first perforation comprising an envelope; and f) a third perforation in at least said front half and parallel to said first and second perforations, said third perforation located in said upper region;

g) said upper and lower regions being separable at said first perforation with at least a portion of said upper region being insertable within a space in said lower region defined between said front and rear halves.

2. The combined letter and envelope of claim 1, further including a flap defined on said front half just below said first perforation, said flap having a rear surface coated with adhesive.

3. The combined letter and envelope of claim 2, further including a strip on said rear half defined between said first and second perforations, whereby removal of said strip exposes said rear surface of said flap.

4. The combined letter and envelope of claim 2, wherein said adhesive comprises a wettable glue.

5. The combined letter and envelope of claim 1, wherein said envelope is partially defined by sides of said front and rear halves, said sides being fastened together with adhesive.

6. The combined letter and envelope of claim 1, wherein said upper region is defined by respective upper portions of said front and rear halves, said portions being fastened together with adhesive.

7. The combined letter and envelope of claim 1, wherein said third perforation extends through said front and rear halves and approximately bisects said upper region.

8. The combined letter and envelope of claim 1, wherein said third perforation divides said upper region into top and bottom portions.

9. The combined letter and envelope of claim 8, wherein said top and bottom portions of said upper region comprise separate pages of a document.

10. A combined letter and envelope comprising:

a) an elongated generally rectangular web folded in half at a crease to define a front half and a rear half, said crease defining lower extents of said halves;

b) a first perforation extending horizontally through said front and rear halves;

c) a second perforation slightly below and parallel to said first perforation and extending solely through said rear half;

d) an upper region above said first perforation comprising a letter or invoice;

e) a lower region below said first perforation comprising an envelope;

f) a third perforation in said front and rear halves and parallel to said first and second perforations, said third perforation approximately bisecting said upper region;

g) a flap defined on said front half just below said first perforation, said flap having a rear surface coated with wettable glue;

h) a strip on said rear half defined between said first and second perforations, whereby removal of said strip exposes said rear surface of said flap;

i) said envelope being partially defined by sides of said front and rear halves, said sides being fastened together with wettable glue;

j) said upper and lower regions being separable at said first perforation with at least a portion of said upper region being insertable within a space in said lower region defined between said front and rear halves.

11. The combined letter and envelope of claim 10, wherein said upper region is defined by respective upper portions of said front and rear halves, said portions being fastened together with adhesive.

12. A combined letter and envelope comprising:

a) an elongated generally rectangular web folded in half at a crease to define a front half and a rear half, said crease defining lower extents of said halves;

b) a first perforation extending horizontally through said front and rear halves;

c) a second perforation slightly below and parallel to said first perforation and extending solely through said rear half;

d) an upper region above said first perforation comprising a letter or invoice;

e) a lower region below said first perforation comprising a first envelope; and f) a third perforation extending through said front half and said rear half and parallel to said first and second perforations, said third perforation located in said upper region and approximately bisecting said upper region;

g) said upper and lower regions being separable at said first perforation with at least a portion of said upper region being insertable within a space in said lower region defined between said front and rear halves and a second envelope being defined between said first and third perforations.

13. The combined letter and envelope of claim 12, further including a fourth perforation extending between said first and third perforations and defining a side of said second envelope and a side of a further region within said upper region.

14. The combined letter and envelope of claim 13, wherein said further region comprises a payment stub.

15. The combined letter and envelope of claim 13, further including a fifth perforation just below said third perforation, said fifth perforation extending solely through said rear half.

* * * * *